US006920742B1

(12) United States Patent
Yu Chen

(10) Patent No.: US 6,920,742 B1
(45) Date of Patent: Jul. 26, 2005

(54) PORTABLE MEMBRANE PACKING APPARATUS

(76) Inventor: Hsiu-Man Yu Chen, No. 27, Sec. 1, Ta Fu Road, Tan Tzu Hsiang, Taichung (TW) 427

( * ) Notice: Subject to any disclaimer, the term of this patent is extended or adjusted under 35 U.S.C. 154(b) by 0 days.

(21) Appl. No.: 10/841,637

(22) Filed: May 10, 2004

(51) Int. Cl.[7] ..... B65B 67/08

(52) U.S. Cl. ..... 53/592; 53/389.4; 53/390; 53/588; 242/588.2; 242/596.4; 156/574; 156/577; 156/579

(58) Field of Search ..... 53/213, 219, 389.1, 53/389.4, 582, 588, 556, 390, 592; 242/588.2, 242/596.4; 156/574, 577, 579

(56) References Cited

U.S. PATENT DOCUMENTS 3,547,737 A * 12/1970 Verecondo ..... 156/468
4,535,951 A * 8/1985 Riemenschneider, III ..... 242/423.2
4,714,211 A * 12/1987 Hwang ..... 242/423.1
4,989,803 A * 2/1991 Lambert et al. ..... 242/422.4
5,038,492 A * 8/1991 Bryant et al. ..... 33/758
5,352,320 A * 10/1994 Schwartz et al. ..... 156/494
5,779,179 A * 7/1998 Zentmyer et al. ..... 242/423.2
6,464,164 B1 * 10/2002 Cox et al. ..... 242/588.2
D470,371 S * 2/2003 Van Glabbeek ..... D8/51
6,739,542 B1 * 5/2004 Prina et al. ..... 242/423.2
2003/0208994 A1 * 11/2003 Gooding et al.

* cited by examiner

*Primary Examiner*—Rinaldi I. Rada
*Assistant Examiner*—Thanh Truong
(74) *Attorney, Agent, or Firm*—Troxell Law Office, PLLC

(57) ABSTRACT

A portable membrane packing apparatus includes a holding-and-drawing rod, two reel connecting units, a first roller unit, a swaying plate, a connecting plate, a second roller unit, and four elastic compressing units. The first roller unit is axially assembled at the ends of the opposite combing rods, and the swaying plate and the connecting plate are respectively provided between the first roller unit and the combining rods, with the swaying plate restricted to sway biasly.

7 Claims, 8 Drawing Sheets

PORTABLE MEMBRANE PACKING APPARATUS

BACKGROUND OF THE INVENTION

1. Field of the Invention

This invention relates to a portable membrane packing apparatus, particularly to one able to quickly carry out packing on a loading plank and the articles piled thereon with membrane with one hand.

2. Description of the Prior Art

Generally, loading planks are extensively employed in factories, warehouses or freight handling centers for articles or commodities to be orderly placed or piled up thereon so as to prevent the them from contacting with the ground and being wetted. When these articles or commodities are to be moved to other locations, a lift truck can be used to prop up the loading plank together with the articles or the commodities piled thereon and move them to a given location.

To prevent the peripheral sides of the articles piled on the loading plank from being soiled and wetted during the process of depositing or to prevent the articles or commodities from swaying or falling in the process of transporting, the loading plank and the articles placed thereon usually have their peripheral sides packed and sealed with membrane. In former times, membrane packing work used to be done manually without help of any accessory, that is, a user had to hold a membrane reel with one hand and draw the membrane out of the membrane reel and carry out packing with the other hand, quite inconvenient in use.

SUMMARY OF THE INVENTION

The objective of the invention is to offer a portable membrane packing apparatus provided with a holding-and-drawing rod having its opposite transverse combining rods respectively assembled thereon with a reel connector at the intermediate section. One of the two reel connectors can be elastically moved inward for the convenience of installing a membrane reel. A first roller unit is axially assembled with the opposite ends of the two combining rods, and a swaying plate and a connecting plate are respectively positioned between the first roller unit and the combining rods. The swaying plate is restricted to sway biasly. A second roller unit is axially assembled between the swaying plate and the connecting plate, able to rotate together with the first roller unit by means of gears and also able to move biasly together with the swaying plate. The membrane of a membrane reel is inserted through between the first and the second roller unit and compressed on the roller of the second roller unit to be drawn outward for packing.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
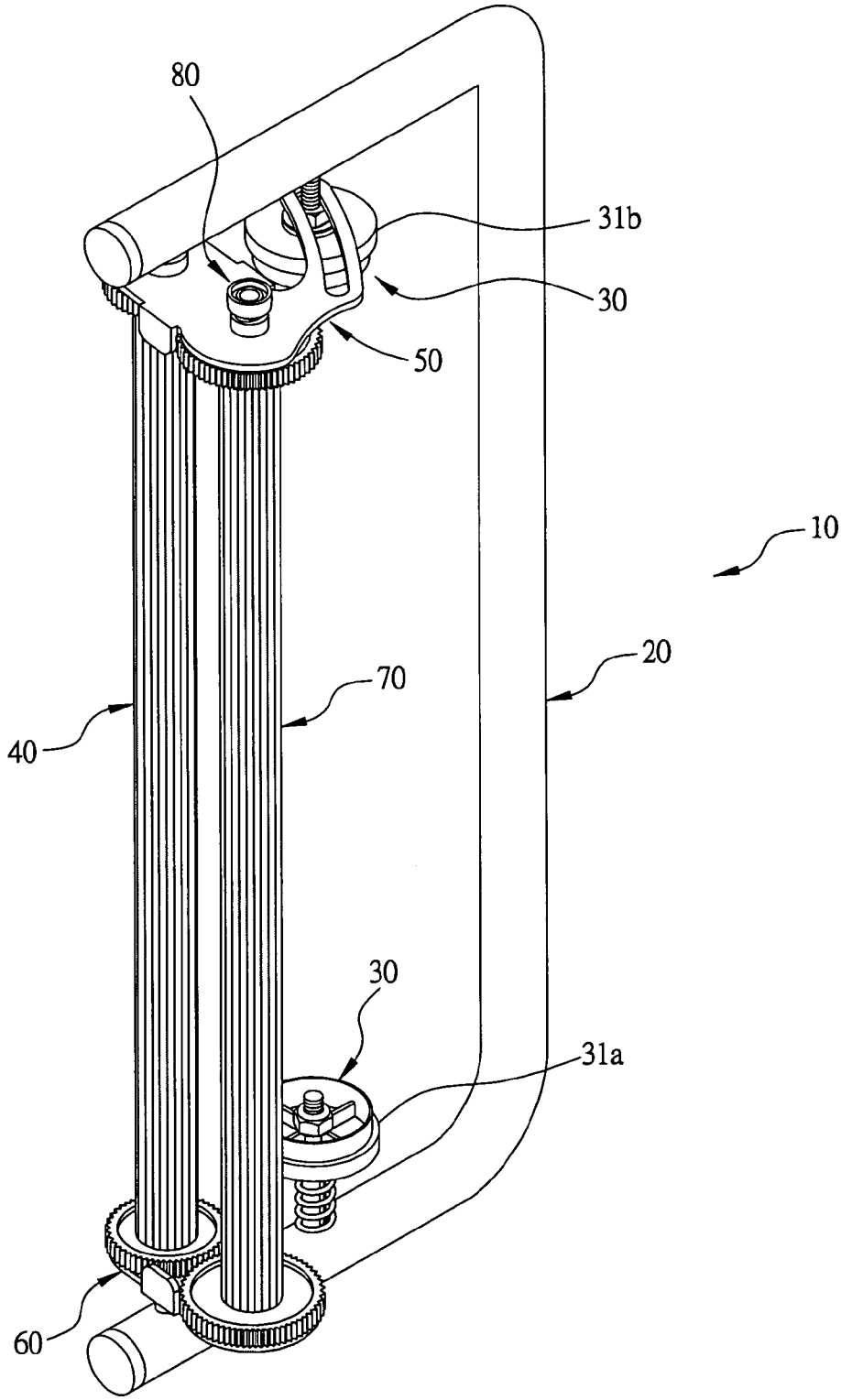
FIG. 1 is a perspective view of a portable membrane packing apparatus in the present invention.
Figure 2:
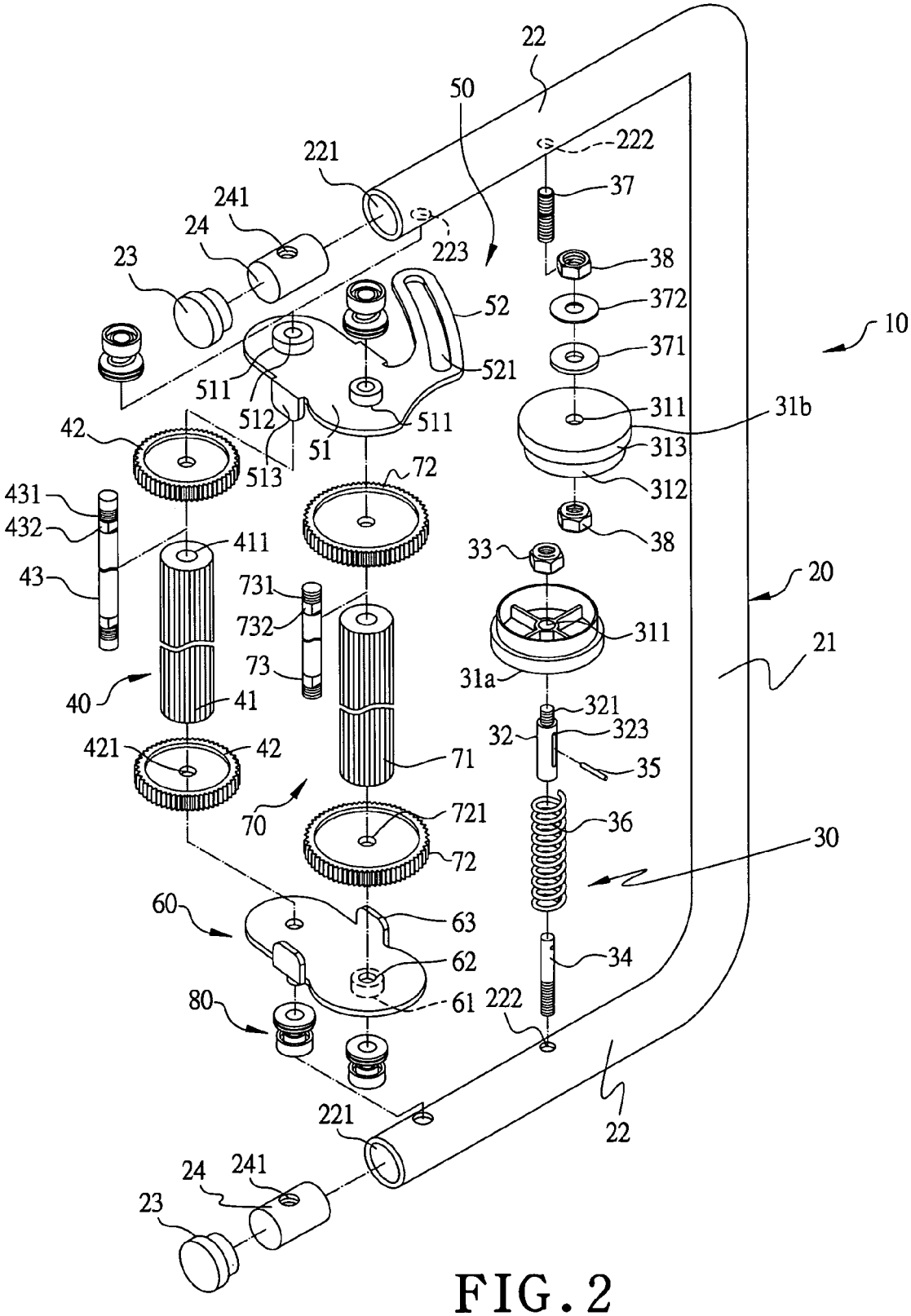
FIG. 2 is an exploded perspective view of the portable membrane packing apparatus in the present invention.

A preferred embodiment of a portable membrane packing apparatus in the present invention, as shown in FIGS. 1 and 2, includes a holding-and-drawing rod 20, two reel connecting units 30, a first roller unit 40, a swaying plate 50, a connecting plate 60, a second roller unit 70 and four elastic compression units 80 combined together.

The holding-and-drawing rod 20 is an elongate round tube having its intermediate portion formed with lengthwise holding rod 21 and its opposite ends respectively bent inward to form a transverse combining rod 22 having a tube end hole 221 to be clogged by an end plug 23. Each combining rod 22 is bored with an insert hole 222 in the inner wall of an intermediate portion and a shaft hole 223 in the inner wall of a portion near the end. The two combining rods 22 have their tube end holes 221 respectively clogged with a column-shaped positioning block 24 having a threaded hole 241 in the circumferential wall and able to be turned around to let its threaded hole 241 aligned to the insert hole 222 of the combining rod 22.

Figure 3:
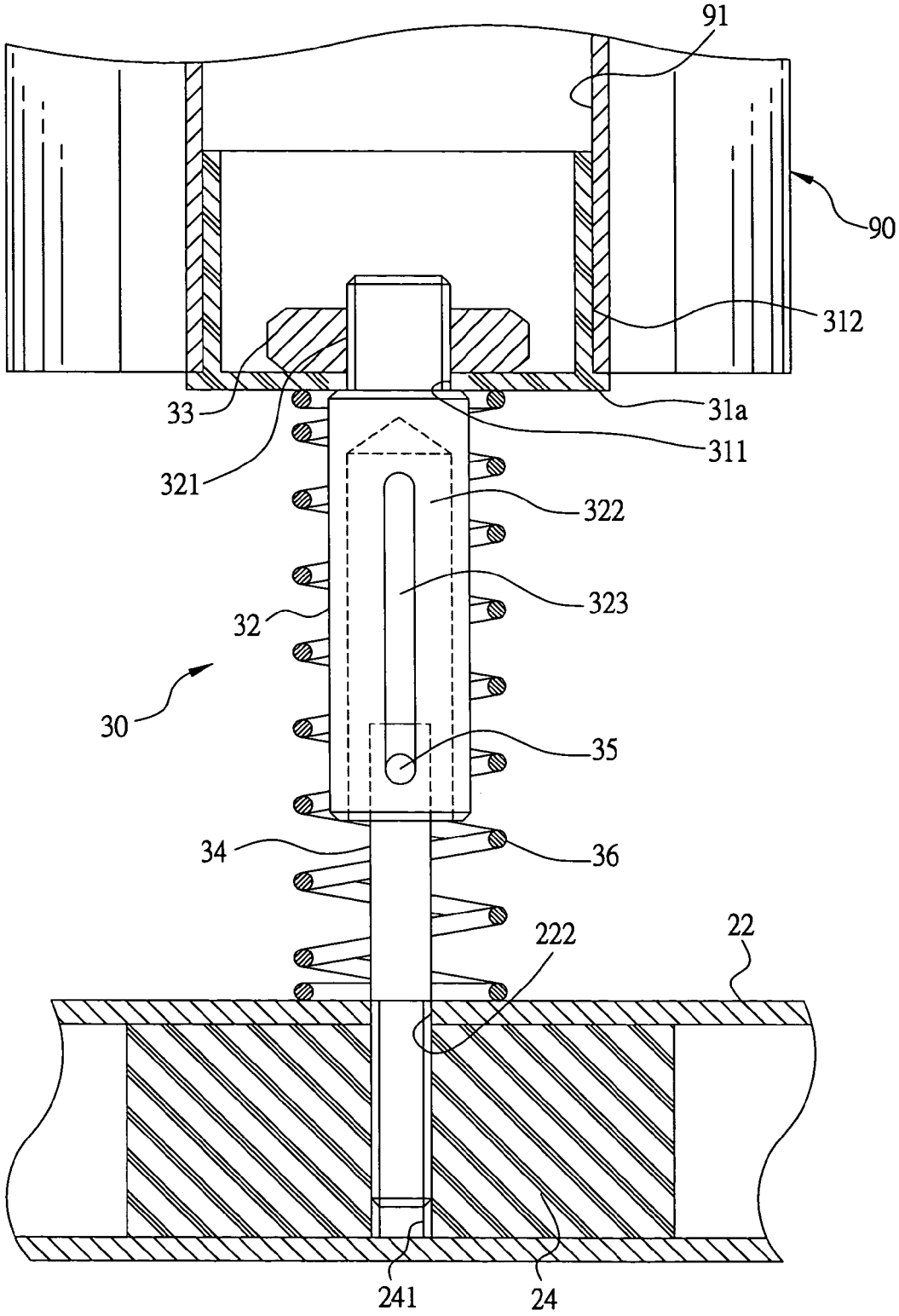
FIG. 3 is a side cross-sectional view of an elastically contractible reel connector in the present invention.

The two reel connecting units 30, as shown in FIG. 3, are respectively formed with an elastically contractible reel connector (31*a*) and a non-contractible reel connector (31*b*). The reel connector (31*a*) and (31*b*) are respectively bored with a shaft hole 311 in the center and respectively have the outer circumferential side formed with a fitting portion 312 having one end extending outward diametrically to form an annular positioning engage edge 313. A toothed tube 32 has one end formed with a small-diameter bolt head 32 to be inserted through the shaft hole 311 of the reel connector (31*a*) and screwed with a nut 33 to fix the toothed tube 32 with the reel connector (31*a*). The toothed tube 32 has the other end bored with a non-through insert hollow 322 having its wall axially cut with two symmetrical position-limiting elongate grooves 323. An inner shaft 34 with an insert hole has its upper end inserted in the insert hollow 322 of the toothed tube 32, and a positioning pin 35 is inserted through the two position-limiting elongate grooves 323 of the toothed tube 32 and the insert hole of the inner shaft 34 to enable the inner shaft 34 to slide axially in the toothed tube 32. In addition, the toothed tube 32 has its outer side fitted around by a spring 36, and the inner shaft 34 has its outer end inserted through the insert hole 222 of one combining rod 22 and then screwed with the threaded hole 241 of the positioning block 24 in the combining rod 22. Thus, the reel connector (31*a*) is fixed at a preset side of the combining rod 22, and the spring 36 has its opposite ends respectively pushing against the reel connector (31*a*) and the relative wall of the combining rod 22, able to push the reel connector (31*a*) to move inward by its resilience.

The reel connector (31*b*) has its shaft hole 311 inserted therein with a shaft bolt 37 having its outer side orderly fitted with a soft gasket 371 and a washer 372. Then, the shaft bolt 37 has one end closely secured on the inner and the outer wall of the shaft hole 311 of the reel connector (31*b*) by two nuts 38, and the other end inserted through the insert hole 222 of the other combining rod 22 and then screwed with the threaded hole 241 of the positioning block 24 in the combining rod 22 to fix the reel connector (31*b*) on the combining rod 22. Thus, a membrane reel 90 can have its opposite end holes 91 respectively and movably fitted with the fitting portions 312 of the two reel connectors (31*a*), (31*b*) after the reel connector (31*a*) is elastically pushed to move inward, keeping the membrane reel 90 in position by the opposite positioning engage edges 313 of the two reel connectors (31*a*), (31*b*) and enabling the membrane reel 90 to rotate and supply membrane 92 for carrying out packing.

The first roller unit 40 includes a roller 41 having its opposite ends respectively fixed with a driven gear 42. The first roller 41 and the two driven gears 42 are respectively bored with a shaft hole 411, 421 in the center for a shaft 43 to be inserted therethrough. The shaft 43 has a portion of its opposite ends respectively formed with male threads 431 and two opposite engage surfaces 432 formed abutting the inner side of the male threads 431. The shaft 43 has its opposite ends respectively inserted in the shaft holes 223 near the ends of the two combining rods 22.

Figure 4:
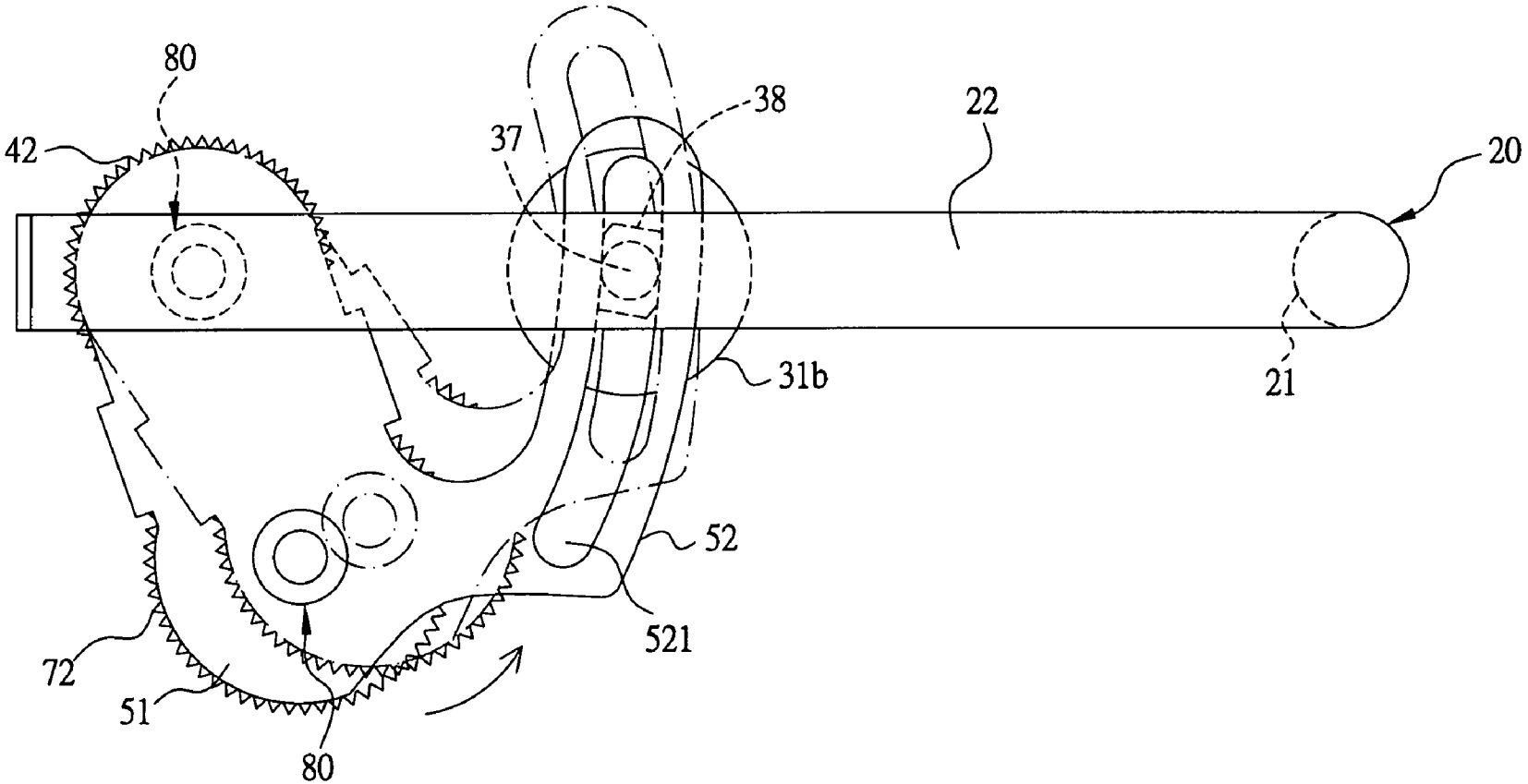
FIG. 4 is an upper view of a swaying plate swaying biasly in the present invention.

The swaying plate 50, as shown in FIG. 4, includes a pivotal portion 51 and a position-limiting portion 52 extending outward horizontally from one end of the pivotal portion 51. The pivotal portion 51 has the outer side of its opposite ends respectively provided with a shaft stud 511 extending upward and having a central shaft hole 512. The shaft hole 512 distant from the position-limiting portion 52 is for one end of the shaft 43 positioned in the first roller unit 40 to be inserted therethrough. The position-limiting portion 52 is bored with a curved guiding groove 521 for the shaft bolt 37 of the reel connector (31*b*) to be fitted therein. Thus, the swaying plate 50 with the shaft 43 acting as a pivot can be properly moved biasly by means of the shaft bolt 37 inserted in the curved guiding groove 521. Further, the pivotal portion 51 has the intermediate portions of its opposite edges respectively bent inward to form a protecting member 513.

The connecting plate 60 has the outer sides of its opposite ends respectively provided with a shaft stud 61 extending upward and having a central shaft hole 62. One of the two shaft holes 62 is for the other end of the shaft 43 positioned in the first roller unit 40 to be inserted therethrough. Further, the connecting plate 60 has the intermediate portions of its opposite edges respectively bent outward to form a protecting member 63.

The second roller unit 70 includes a second roller 71 having its opposite ends respectively fixed with an actuating gear 72. The second roller 71 and the two actuating gear 72 are respectively bored with a shaft hole 711, 721 in the center for a shaft 73 to be inserted therethrough. The shaft 73 has its opposite end portions respectively formed with male threads 731 and two engage surfaces 732 formed abutting the inner side of the male threads 731, having its opposite ends respectively inserted in the shaft hole 512 of the swaying plate 50 near the position-limiting portion 52 and the other shaft hole 62 of the connecting plate 60. The two actuating gears 72 are respectively meshed with the two driven gears 42 so that the first roller 41 can be rotated together with the second roller 71 when the second roller 71 is rotated.

Figure 5:
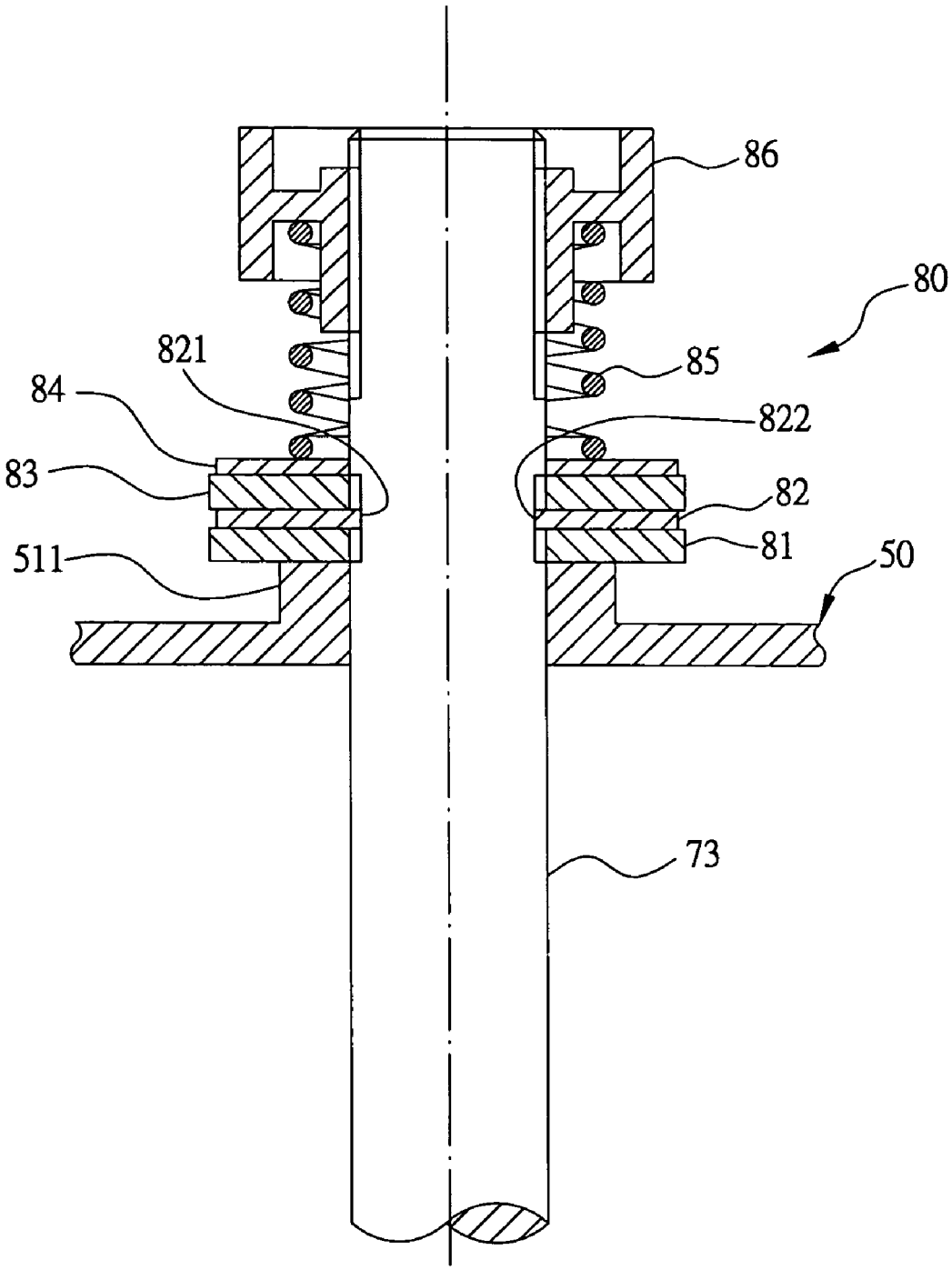
FIG. 5 is a side cross-sectional view of an elastic compression unit in the present invention.

The four elastic compression units 80, as shown in FIG. 5, are respectively composed of a first soft gasket 81, a position-limiting washer 82, a second soft gasket 83, a washer 84 and a spring 85, which are orderly fitted around the shafts 43, 73 extending out of the outer sides of the swaying plate 50 and the connecting plate 60. The position-limiting washer 82 has its shaft hole 821 formed with two opposite engage edges 822 to be engaged with the two engage surfaces 432, 732 at the opposite ends of the shafts 43, 73 to restrict the position-limiting gasket 82 to rotate thereon. The shafts 43, 73 respectively have the male threads 431, 731 at the opposite ends respectively screwed with a nut 86. Thus, when properly compressed, the springs 85 will have their other ends respectively compressing and forcing the first and the second soft gasket 81, 83 to compress the walls of the shaft studs 511, 61 of the swaying plate 50 and the connecting plate 60. Synchronously, the swaying plate 50 and the connecting plate 60 will respectively compress the actuating gears 72 and the driven gears 42 to let the first roller 41 and the second roller 71 produce proper rotation resistance.

Figure 6:
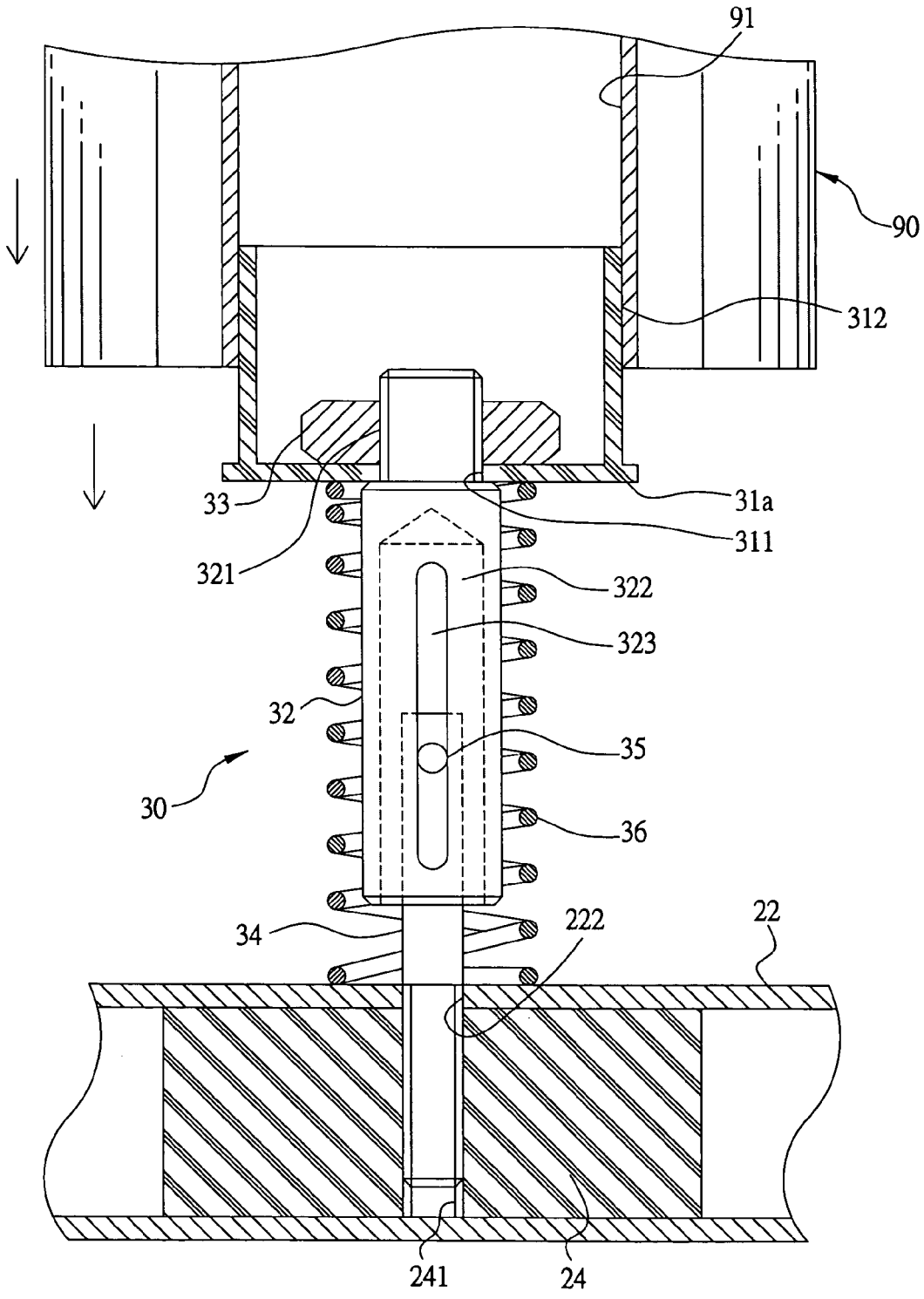
FIG. 6 is a side cross-sectional view of a membrane reel assembled with the reel connector in the present invention.
Figure 7:
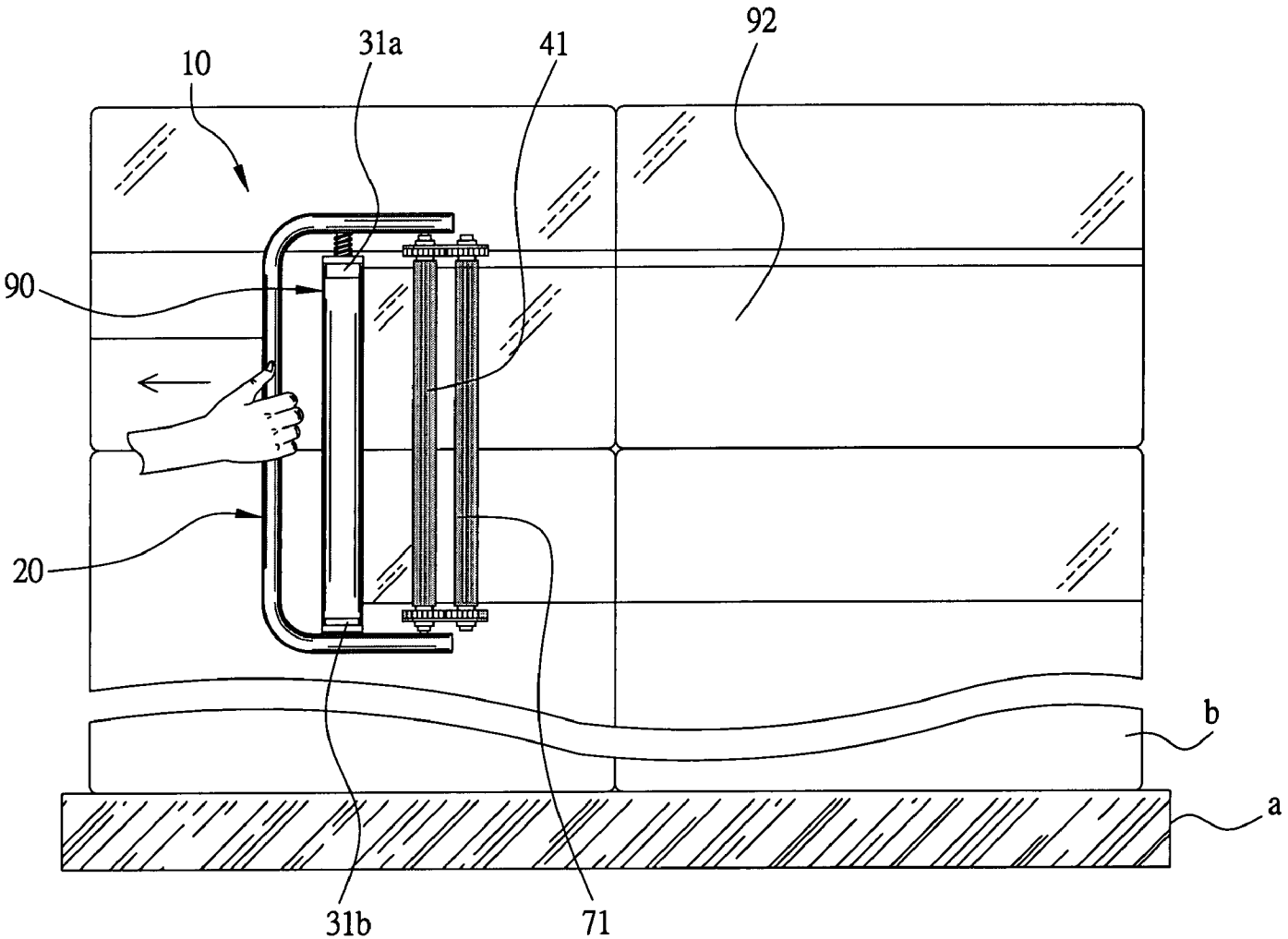
FIG. 7 is a front view of the portable membrane packing apparatus carrying out packing around a loading plank and the articles piled thereon in the present invention.
Figure 8:
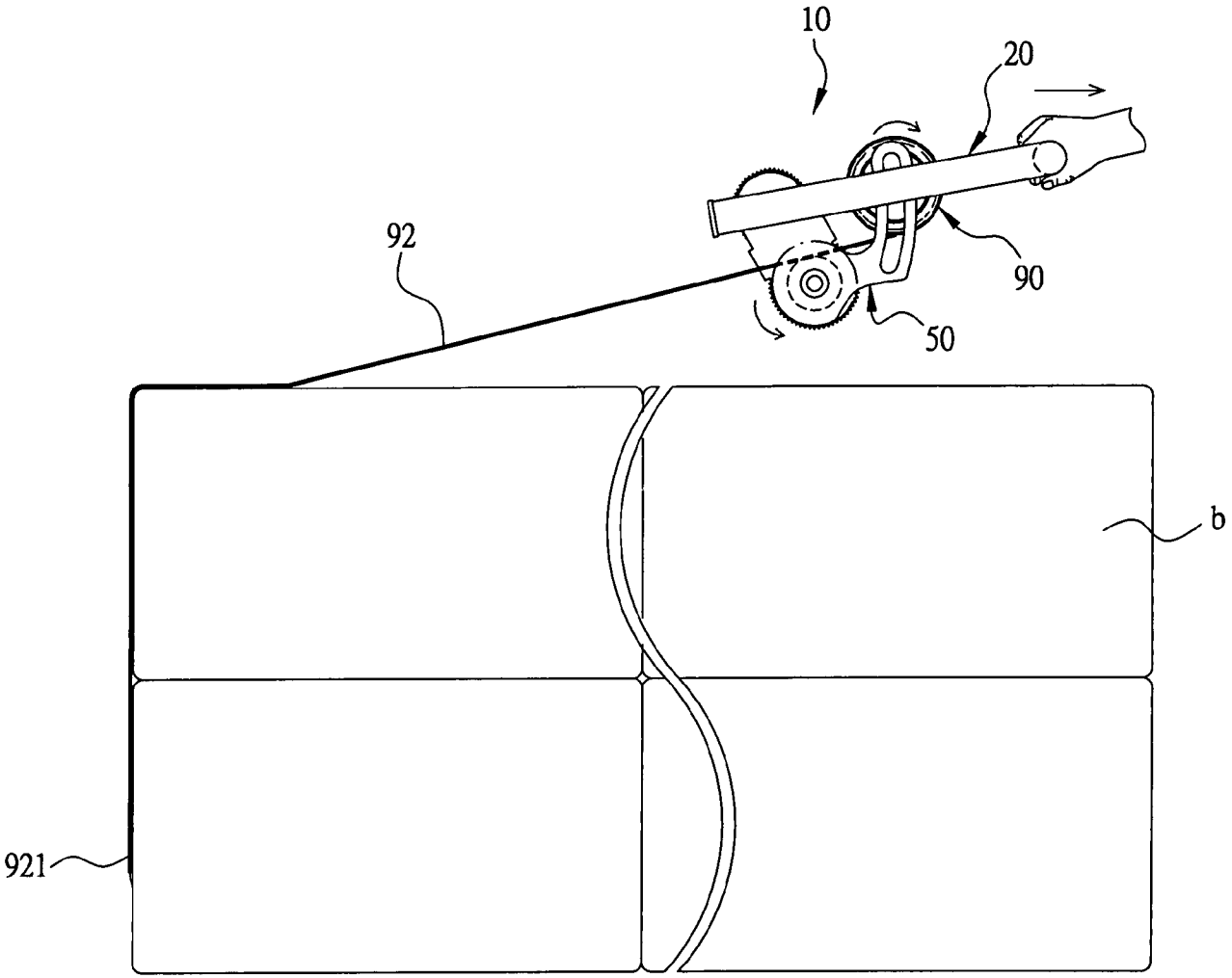
FIG. 8 is an upper view of the portable membrane packing apparatus in a packing condition in the present invention.

In using, as shown in FIGS. 6 and 7, firstly, the reel connector (31*a*) is elastic ally pressed to move inward and a membrane reel 90 is assembled between the reel connectors (31*a*), (31*b*). Then, the membrane 92 of the membrane reel 90 is drawn outward to pass through between the first roller 41 and the second roller 71. Next, hold the holding rod 21 of the holding-and-drawing rod 20 with one hand to let the second roller 71 positioned close to one side of the articles (b) to be packed and then draw the membrane 92 forward to a certain distance and paste it at a starting side of the periphery of the articles (b) piled on a loading plank (a) with the other hand and then temporarily press and position the outer end 921 of the membrane 92 on the articles (b). Subsequently, the packing apparatus 10 is held and moved around other peripheral sides of the articles (b) to let the membrane 92 stuck on the turns of the starting side and the other sides of the articles (b). Lastly, as shown in FIGS. 7 and 8, hold the packing apparatus 10 with one hand and walk around the articles (b) to paste the membrane 92 around the peripheral sides of the articles (b) and the loading plank (b) from the top to the bottom in an interposed and overlapped condition and then tear off the membrane 92 after the articles (b) and the loading plank (a) are completely packed and sealed up.

As can be understood from the above description, this invention has the following advantages.

1. It is simple in structure and can be operated completely by hand to carry out packing, economizing more expense for both assembly and maintenance than a conventional electrical membrane-packing machine needs.

2. It is small and light, convenient to be stored or carried about.

3. It is light and easy to be held and moved around to carry out membrane packing quickly, needless to move the loading plank (a) and the articles (b) piled thereon.

4. It is easy to install the membrane reel 90 on the packing apparatus 10 and convenient to draw the membrane 92 outward to carry out packing and tear off the membrane 92 after finishing packing, able to carry out membrane packing efficiently.

5. The packing apparatus 10 can be controlled by hand to carry out membrane packing with one round of process; therefore, it can carry out membrane packing more quickly than a mechanical device and, due to a comparatively short packing course, it can shorten the total length of the membrane 92 needed for packing, economizing cost in using material needed.

6. The reel connector (31*a*) of the packing apparatus 10 can be elastically pushed to move inward; therefore, the membrane reel 90 can be assembled with or disassembled from the two reel connectors (31*a*) and (31*b*) easily and quickly.

7. The four elastic compression units 80 of the packing apparatus 10 enable the first and the second roller 41, 71 to produce proper rotation resistance to prevent the membrane 91 from being moved outward excessively freely and causing inconvenience in using.

8. The second roller unit 70 and the connecting plate 60 of the packing apparatus 10 can be actuated to move biasly together with the swaying plate 50 so as to enable a user to hold the holding-and-drawing rod 20 and supply the membrane 92 quickly and smoothly at various angles, able to supply the membrane 92 for packing around the peripheral sides of the loading plank (a) and the articles (b) piled thereon.

9. The membrane reel 90 can be quickly assembled with or disassembled from the packing apparatus 10, and the membrane 92 can be drawn out for use smoothly, conforming to ergonomics in holding and handling of the packing apparatus 10.

While the preferred embodiment of the invention has been described above, it will be recognized and understood that various modifications may be made therein and the appended claims are intended to cover all such modifications that may fall within the spirit and scope of the invention.

I claim:

1. A portable membrane packing apparatus comprising:

a holding-and-drawing rod having a lengthwise holding rod, said lengthwise holding rod having its opposite ends respectively bent and formed with a transverse combining rod;

two reel connectors respectively assembled at intermediate portions of said two combining rods, one of said two reel connectors able to be elastically moved inward at a preset distance, a membrane reel able to be respectively and movably assembled with said two reel connectors after said elastically contractible reel connector is moved inward, said membrane reel rotated to supply membrane for packing;

a first roller unit having a first roller, said first roller having its opposite ends respectively fixed with a driven gear, said two driven gears respectively and axially assembled on the inner wall of the end of said combining rod;

a second roller unit positioned beside said first roller unit and having a second roller, said second roller having its opposite ends respectively fixed with an actuating gear;

a swaying plate having a preset portion of one side pivotally assembled between the first of said driven gears of said first roller unit and said combining rod by the same shaft of said first roller, said swaying plate having a preset portion of the opposite side pivotally assembled on the outer side of the first of said actuating gear of said second roller by the same shaft of said second roller, said actuating gears of said second roller respectively meshing with said driven gears of said first roller, said swaying plate having another side bored with a curved guiding groove at a preset portion, said reel connector having its shaft bolt inserted in said curved guiding groove of said swaying plate, said swaying plate restricted to move biasly by said curved guiding groove for said shaft bolt to move along therein; and a connecting plate having a preset portion of one side pivotally assembled between the second of said driven gears of said first roller and said combining rod by the same shaft of said first roller, said connecting plate having a preset portion of the opposite sides pivotally assembled at the outer side of the second of said actuating gear of said second roller by the same shaft of second roller, said driven gears of said first roller respectively meshing with said actuating gears of said second roller, said membrane moved out of said membrane reel to pass through between said first and said second roller, said membrane then compressed on said second roller to be drawn outward for carrying out packing around a loading plank and the articles piled thereon.

2. The portable membrane packing apparatus as claimed in claim 1, wherein each said reel connector having its outer peripheral edge formed with a fitting portion, said fitting portion having one end extending outward diametrically and forming a positioning engage edge, said membrane reel having its opposite end holes respectively fitted with said fitting portions of said two reel connectors, said membrane reel kept in position by said two opposite positioning engage edges of said two reel connectors.

3. The portable membrane packing apparatus as claimed in claim 1, wherein a toothed tube has its bolt head at one end inserted through the central shaft hole of said elastically contractible reel connector and screwed with a nut and has its other end bored with a non-through insert hollow having its wall axially cut with two symmetrical elongate positioning grooves, an inner shaft having one end inserted in said insert hollow of said toothed tube and positioned therein by a pin, said inner shaft restricted to slide axially along said elongate positioning grooves, said toothed tube having its outer side fitted around by a spring, said inner shaft having its outer end inserted in said combining rod and screwed with a positioning block received in said combining rod, said elastically contractible reel connector connected with and positioned on said combining rod by said inner shaft, said spring having its opposite ends respectively pushing against said elastically contractible reel connector and the wall of said combining rod, said elastically contractible reel connector able to be moved in ward.

4. The portable membrane packing apparatus as claimed in claim 1, wherein a shaft bolt has one end inserted through the shaft hole of said reel connector which is unable to be elastically contracted inward, and then secured with said non-contractible reel connector by two nuts, and said shaft bolt has the other end inserted in said combining rod and screwed with a positioning block received in said combining rod, said non-contractible reel connector connected with and positioned on said combining rod.

5. The portable membrane packing apparatus as claimed in claim 1, wherein said first roller, said second roller, said driven gears, said actuating gears and the relative portions of said swaying plate and said connecting plate and said combining rods are respectively bored with a shaft hole for two shafts to be respectively inserted there through, each said shaft having a portion of its opposite ends respectively formed with male threads, said male threads having the outer circumferential wall of its inner side formed with two opposite engage surfaces, the opposite ends of said two shafts protruding out of said swaying plate and said connecting plate respectively assembled with an elastic compression unit, each said elastic compression unit consisting of a first soft gasket, a position-limiting washer, a second soft gasket, a washer and a spring orderly fitted with the end of said shaft, said position-limiting gasket having its shaft hole formed with two opposite engage edges to be engaged with said two engage surfaces at the end of said shaft, said shaft having its opposite male threads respectively screwed with a nut, said spring properly compressed to have the other end compressing said first soft gasket, said first soft gasket then compressing the wall of said swaying plate and said connecting plate, said swaying plate and said connecting plate then compressing said actuating gear and said driven gear, said first and said second roller able to produce proper rotation resistance.

6. The portable membrane packing apparatus as claimed in claim 1, wherein said swaying plate and connecting plate are respectively provided with two opposite protecting members bent and extending vertically from the opposite side edges facing the meshing portion of said actuating gear and said driven gear for protecting a user's hand from touching said meshing portion and being hurt.

7. The portable membrane packing apparatus as claimed in claim 1, wherein said holding-and-drawing rod is an elongate round tube having its opposite ends respectively bent and formed with said transverse combining rod having an end hole inserted therein with an end plug, and each said transverse combining rod is bored with an insert hole at the inner wall facing said reel connector, said positioning block shaped a column having its circumferential wall bored with a threaded hole, said positioning block received in said combining rod through said end hole, said positioning block in said combining rod rotatable to let said threaded hole aligned to said insert hole of said combining rod, said inner shaft of said reel connector having its outer end screwed with said threaded hole of said positioning block positioned in said combining rod.

* * * * *